US006578484B2

(12) United States Patent
Fusco

(10) Patent No.: US 6,578,484 B2
(45) Date of Patent: Jun. 17, 2003

(54) PRINTING PLATE LOCK-UP ASSEMBLIES HAVING JAW ASSEMBLY AND REGISTRATION PIN ASSEMBLY

(75) Inventor: Ralph L. Fusco, Commack, NY (US)

(73) Assignee: Masthead International, Inc., Phoenix, AZ (US)

( * ) Notice: Subject to any disclaimer, the term of this patent is extended or adjusted under 35 U.S.C. 154(b) by 0 days.

(21) Appl. No.: 09/880,108

(22) Filed: Jun. 14, 2001

(65) Prior Publication Data

US 2002/0189472 A1 Dec. 19, 2002

(51) Int. Cl.[7] ..... B41F 27/06; B41F 27/12
(52) U.S. Cl. ..... 101/415.1; 101/378
(58) Field of Search ..... 101/415.1, 378, 101/DIG. 36, 409, 485, 486

(56) References Cited

U.S. PATENT DOCUMENTS

| | | | | | |
|---|---|---|---|---|---|
| 3,727,551 | A | | 4/1973 | Kostas et al. | 101/415.1 |
| 4,191,106 | A | | 3/1980 | Fermi et al. | 101/415.1 |
| 4,376,414 | A | * | 3/1983 | Burger et al. | 101/415.1 |
| 4,421,024 | A | * | 12/1983 | Burger et al. | 101/415.1 |
| 4,459,913 | A | | 7/1984 | Kowalik | 101/415.1 |
| 4,840,121 | A | | 6/1989 | Szczesniak | 101/415.1 |
| 5,074,210 | A | | 12/1991 | Reichel | 101/415.1 |
| 5,156,091 | A | | 10/1992 | Bätz | 101/415.1 |
| 5,186,108 | A | | 2/1993 | Hillebrand | 101/415.1 |
| 5,189,958 | A | | 3/1993 | Tafel et al. | 101/415.1 |
| 5,255,056 | A | | 10/1993 | Preszler et al. | 355/211 |
| 5,327,832 | A | | 7/1994 | Fischer | 101/415.1 |
| 5,485,783 | A | * | 1/1996 | Rau et al. | 101/378 |
| 5,485,784 | A | | 1/1996 | Walschlaeger, Sr. | 101/415.1 |
| 5,806,431 | A | | 9/1998 | Muth | 101/486 |
| 6,164,205 | A | | 12/2000 | Metrope | 101/415.1 |
| 6,401,617 | B1 | * | 6/2002 | Lyndhurst | 101/415.1 |

* cited by examiner

*Primary Examiner*—Leslie J. Evanisko
(74) *Attorney, Agent, or Firm*—Nixon & Vanderhye P.C.

(57) ABSTRACT

Lock-up assemblies clamp a flexible print plate to a circumferential surface of the print plate cylinder. Preferably, the print plate lock-up assemblies are adapted to being received within a gutter of a print plate cylinder and include an elongate support bar assembly, and a jaw assembly supported by the support bar assembly and adapted for positionally clamping a print plate to an exterior circumferential surface of the print plate cylinder. Preferably, the jaw assemblies include a pair of retainer blocks which are spaced from one another along the support bar assembly, and a jaw support plate positioned between the pair of retainer blocks and adapted for movement along the pair of retainer blocks towards and away from the support bar. A pair of mirror-imaged jaw members is positioned upon and supported by said jaw support plate. One or more spring members act between the support bar assembly and the jaw support plate so as to exert a bias force against the jaw support plate to thereby move the jaw support plate, and the pair of jaw members supported thereby, in a direction away from said support bar assembly. In such a manner, the jaw members may be moved into clamping relationship with the print plate gutter. A registration pin assembly may be provided which is shiftable between one and another locations along the support bar assembly to thereby accommodate print plates of different widths.

10 Claims, 7 Drawing Sheets

PRINTING PLATE LOCK-UP ASSEMBLIES HAVING JAW ASSEMBLY AND REGISTRATION PIN ASSEMBLY

FIELD OF THE INVENTION

The present invention relates generally to printing plate clamping assemblies known colloquially in this art, and referred to as such below, as "lock-up" assemblies. In especially preferred forms, the present invention is embodied in printing plate lock-up assemblies which may adjustably accommodate different print plate widths (i.e., so as to allow printing onto different web widths).

BACKGROUND AND SUMMARY OF THE INVENTION

It is increasingly becoming a necessity for newspaper and magazine publishers to be capable of accommodating narrower width paper webs. For example, many newspaper publishers have decided to reduce the newspaper width so as to conserve newsprint. At the same time, however, such publishers may from time to time have a need to utilize their printing presses in order to print publications on paper webs having a wider width as compared to the narrower width of the newsprint that is desired to be employed. While a variety of lock-up devices have been proposed in the past (see, for example, U.S. Pat. No. 4,191,106 to Fermi et al, U.S. Pat. No. 5,186,108 to Hillebrand and U.S. Pat. No. 5,327,832 to Fischer, the entire content of each being expressly incorporated hereinto by reference) to allow for print plates of different widths to be used on a given print plate cylinder (and thereby allow for different web to be printed), some further improvements are still desired.

For example, it would be highly desirable if a lock-up assembly could be provided with a registration pin that is laterally (i.e., along the longitudinal axis of the printing press and thus in the width-wise dimension of the printing plate carried thereby) shiftable between one and another positions (i.e., so as to accommodate different printing plate widths) without necessarily moving the lateral position of the lock-up jaws. Furthermore, it would be highly desirable if the lock-up jaws were capable of being shifted laterally in a convenient manner so as to also be capable of accommodating different printing plate widths. It is towards providing such lock-up assemblies that the present invention is directed.

Broadly, the present invention is embodied in lock-up assemblies so as to clamp a flexible print plate to a circumferential surface of the print plate cylinder. In especially preferred embodiments, the print plate Lock-up assemblies of the present invention are adapted to being received within a gutter of a print plate cylinder and include an elongate support bar assembly, and a jaw assembly supported by the support bar assembly and adapted for positionally clamping a print plate to an exterior circumferential surface of the print plate cylinder.

Preferably, the jaw assemblies include a pair of retainer blocks which are spaced from one another along the support bar assembly, and a jaw support plate positioned between the pair of retainer blocks and adapted for movement along the pair of retainer blocks towards and away from the support bar. A pair of mirror-imaged jaw members is positioned upon and supported by said jaw support plate. One or more spring members act between the support bar assembly and the jaw support plate so as to exert a bias force against the jaw support plate to thereby move the jaw support plate, and the pair of jaw members supported thereby, in a direction away from said support bar assembly. In such a manner, the jaw members may be moved into clamping relationship with the print plate gutter.

The lock-up assemblies of the present invention also most preferably include a registration pin assembly which may be shiftable between one and another locations along the support bar assembly. Most preferably, the registration pin assembly is positioned between a pair of the jaw assemblies as noted above and includes a pin cradle supported which is shiftable along the support bar assembly, and defines a slot oriented generally transverse to the support bar assembly (and to the gutter). A registration pin is received within the slot of the pin cradle and defines a threaded bore. A threaded jack screw is threadably received within such threaded bore of the registration pin so that a terminal end thereof bears against the pin cradle. When turning movements are therefore applied to the jack screw, the registration pin will responsively be raised or lowered relative to said pin cradle. In this manner, the registration pin may be brought into and out of positive locking engagement with the plate cylinder gutter.

According to yet another aspect of this invention, gauge systems and methods are provided to ensure accurate placement within an elongate print cylinder gutter of a registration pin assembly having a pin cradle which is shiftable between one and another locations within the gutter, a registration pin oriented substantially transverse to the gutter, and a jack screw received within a threaded bore of the registration pin and such that a terminal end thereof bears against the pin cradle to responsively cause the registration pin to be jacked into and out of engagement with the cylinder gutter. More specifically, the gauge system includes a gauge bar positioned on an exterior surface of the print plate cylinder and having at least one elongate window through which the registration pin assembly is accessible, and first and second stops separated from one another along the elongate window which establish the one and another locations of the registration pin assembly. A gauge block may be placed over the elongate window of the gauge bar and has a base plate adapted for slidable movement along the gauge bar between such first and second stops. A finger block is provided with the gauge block which is engageable with the registration pin. A through bore in registry with the jack screw of the registration pin assembly is formed in the gauge block.

A turning tool may therefore be inserted into said through bore so as to engage with said jack screw and allow turning movements to be applied thereto. In such a manner, turning movements applied in one direction causes the registration pin to be jacked away from positive locking engagement with the gutter to allow for the registration pin assembly and the gauge block to be slideably moved as a unit between the first and second stops of said gauge bar to thereby shift said registration pin assembly from one location to said another location thereof, respectively. By applying turning movement in another direction upon the registration pin assembly being positioned at another location, the registration pin will then be jacked into positive engagement with the cylinder gutter to thereby positionally retain the registration pin assembly at that another location.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

Figure 6:
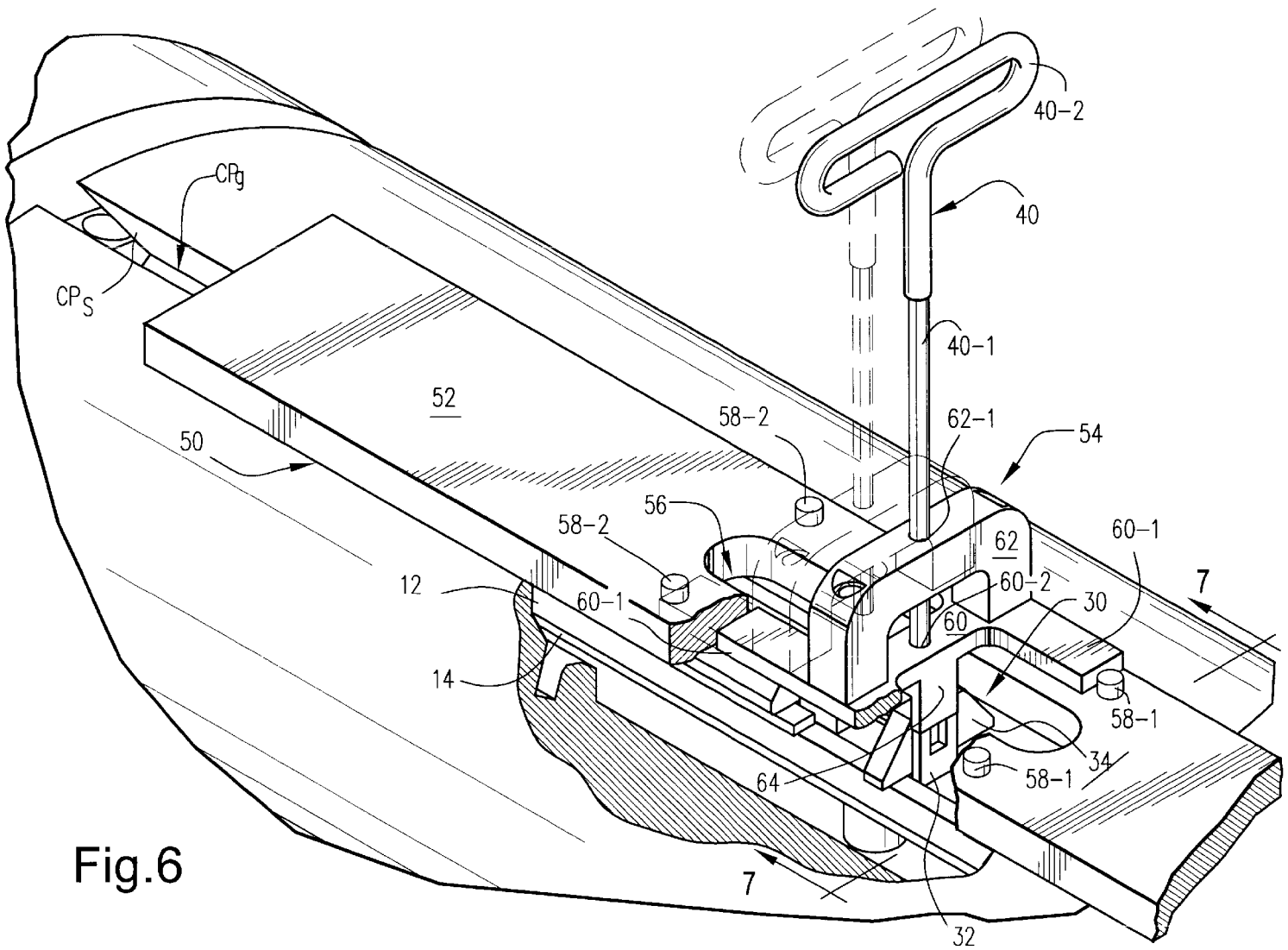
Figure 7:
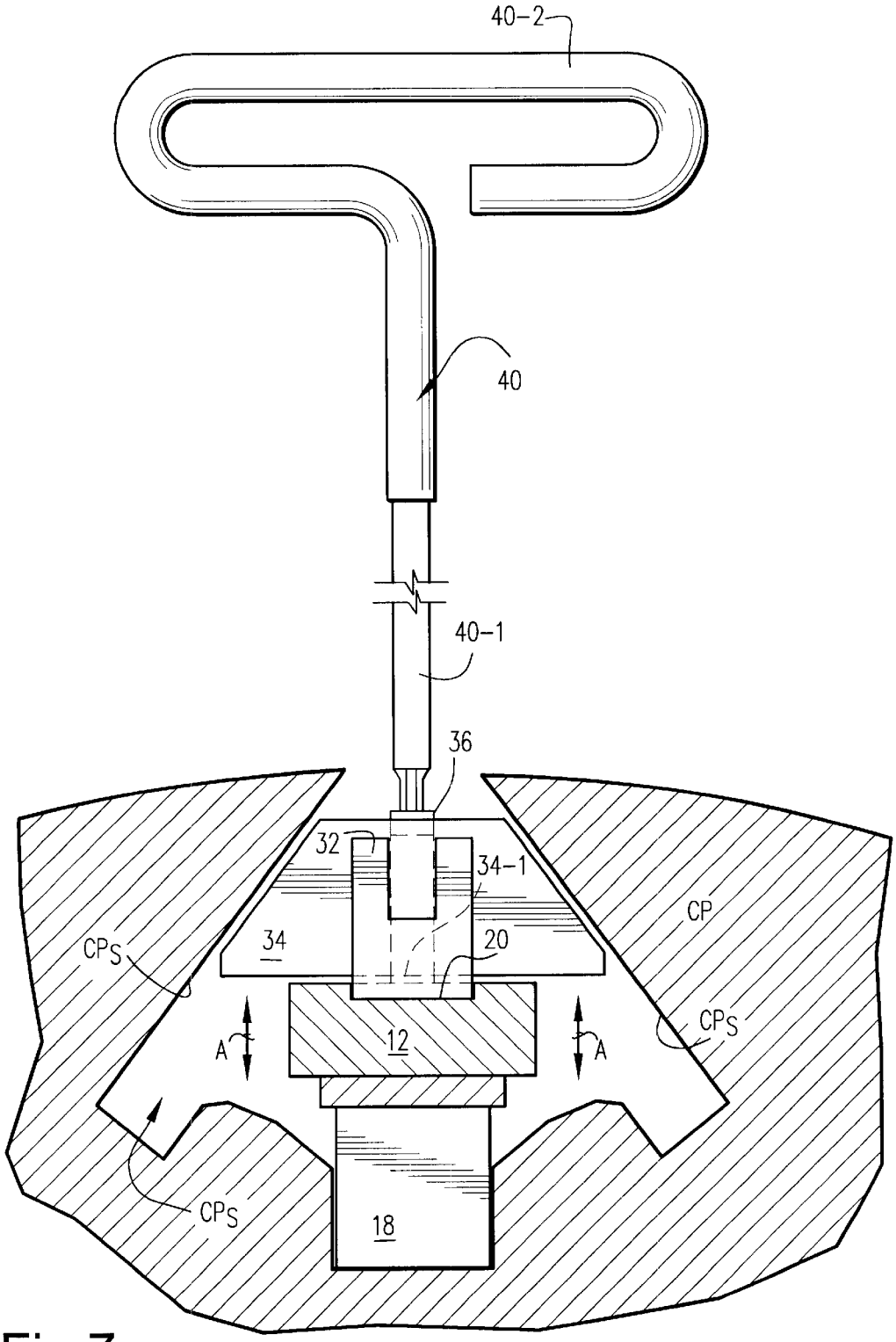

FIG. 6 is an enlarged perspective view, partly in section, showing the manner in which the gauge assembly of the present invention may be used so as to accurately laterally shift registration pin assemblies associated with the lock-up assembly; and FIG. 7 is an enlarged cross-sectional view taken along line 7—7 in FIG. 6, but omitting for the purpose of improved clarity of presentation the gauge block employed to positionally shift the registration pin assemblies between one and another locations.

DETAILED DESCRIPTION OF THE INVENTION

Figure 1:
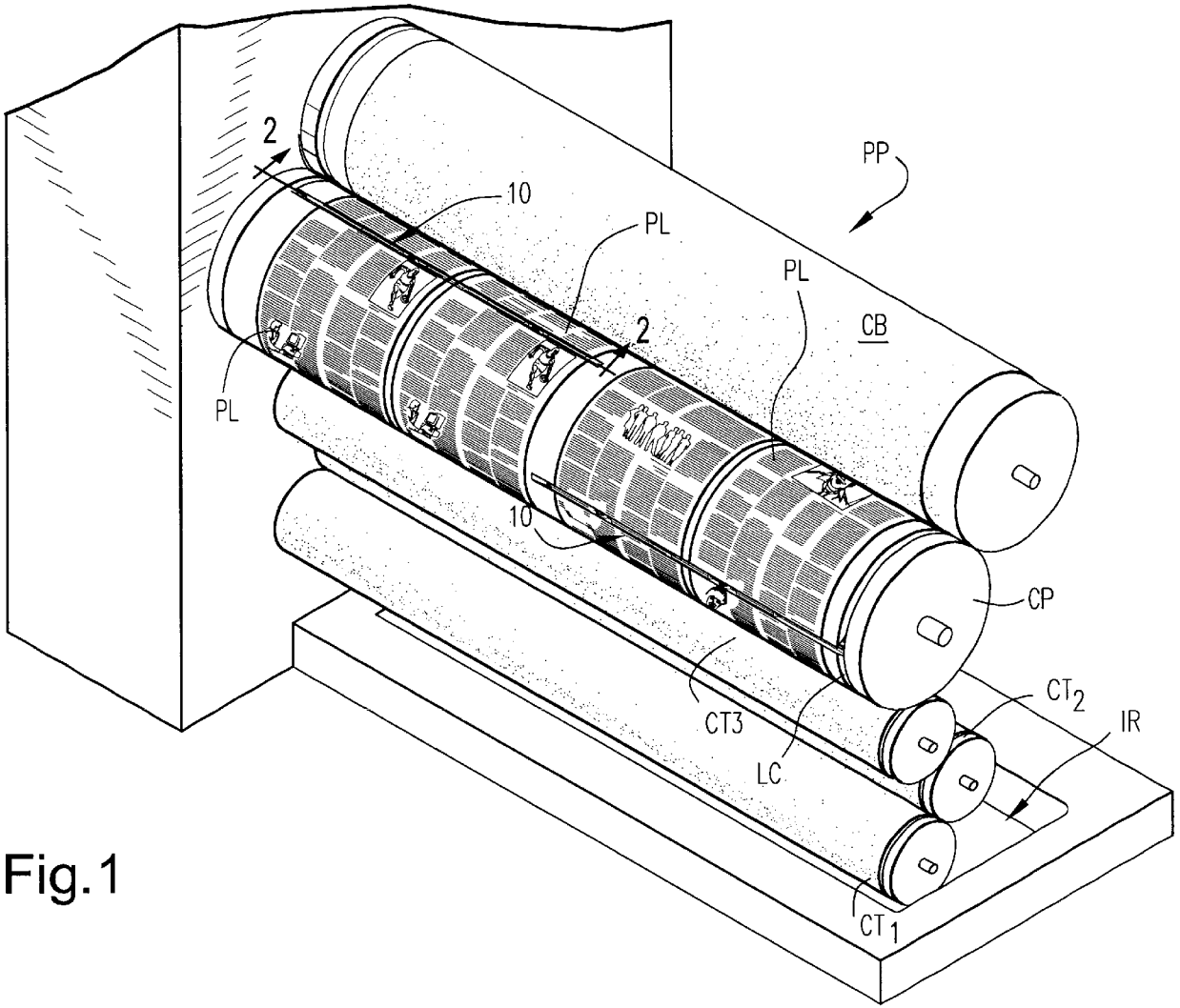
FIG. 1 is a schematic perspective view of an exemplary portion of an off-set printing press which include the lock-up assemblies of the present invention.

Accompanying FIG. 1 depicts schematically a representative portion of an off-set printing press PP. In this regard, as is highly conventional, the printing press PP includes a plurality of ink transfer cylinders CT1–CT3 which serve to transfer ink from ink reservoir IR onto the printing plates PL held on the circumferential exterior surface of a print plate cylinder CP by means of the lock-up assemblies 10 in accordance with the present invention. A reverse image is therefore transferred from the printing plates PL onto the blanket cylinder CB which then in turn transfers the image onto a moving web (not shown), such as newsprint.

It will be understood by those in this art that print plate cylinders CP generally will accommodate eight individual print plates PL. Thus, the print plate cylinder CP will include two diametrically opposed sets of lock-up assemblies 10 which are off-set from one another by about 90°. For ease of discussion, only a single representative one of the lock-up assemblies will be discussed in greater detail below, but it will be understood that such discussion is applicable to all similar lock-up assemblies employed on the print plate cylinder CP.

Figure 2:
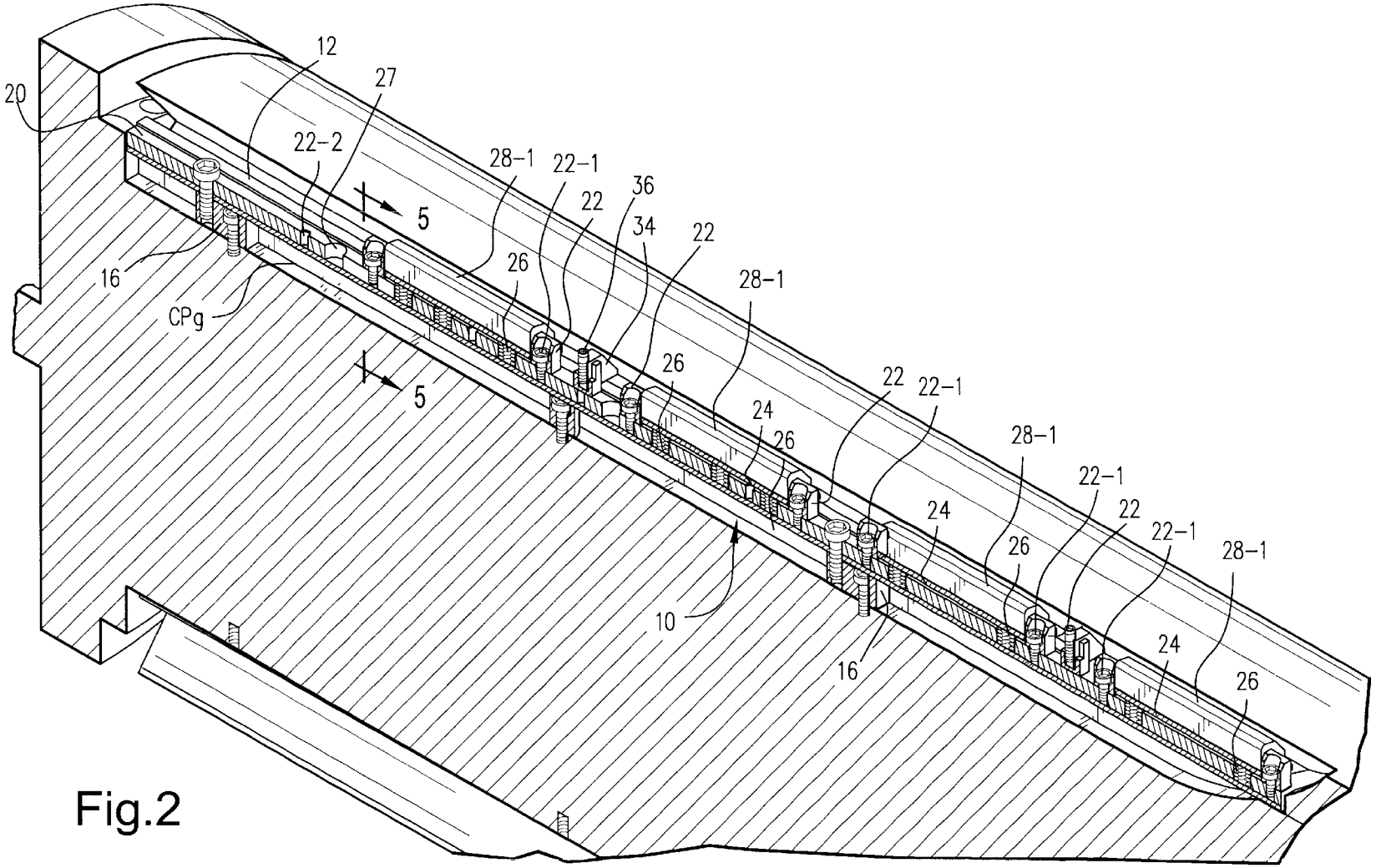
FIG. 2 is a longitudinal cross-section of a part of the printing plate roll which includes a lock-up assembly in accordance with the present invention.
Figure 3:
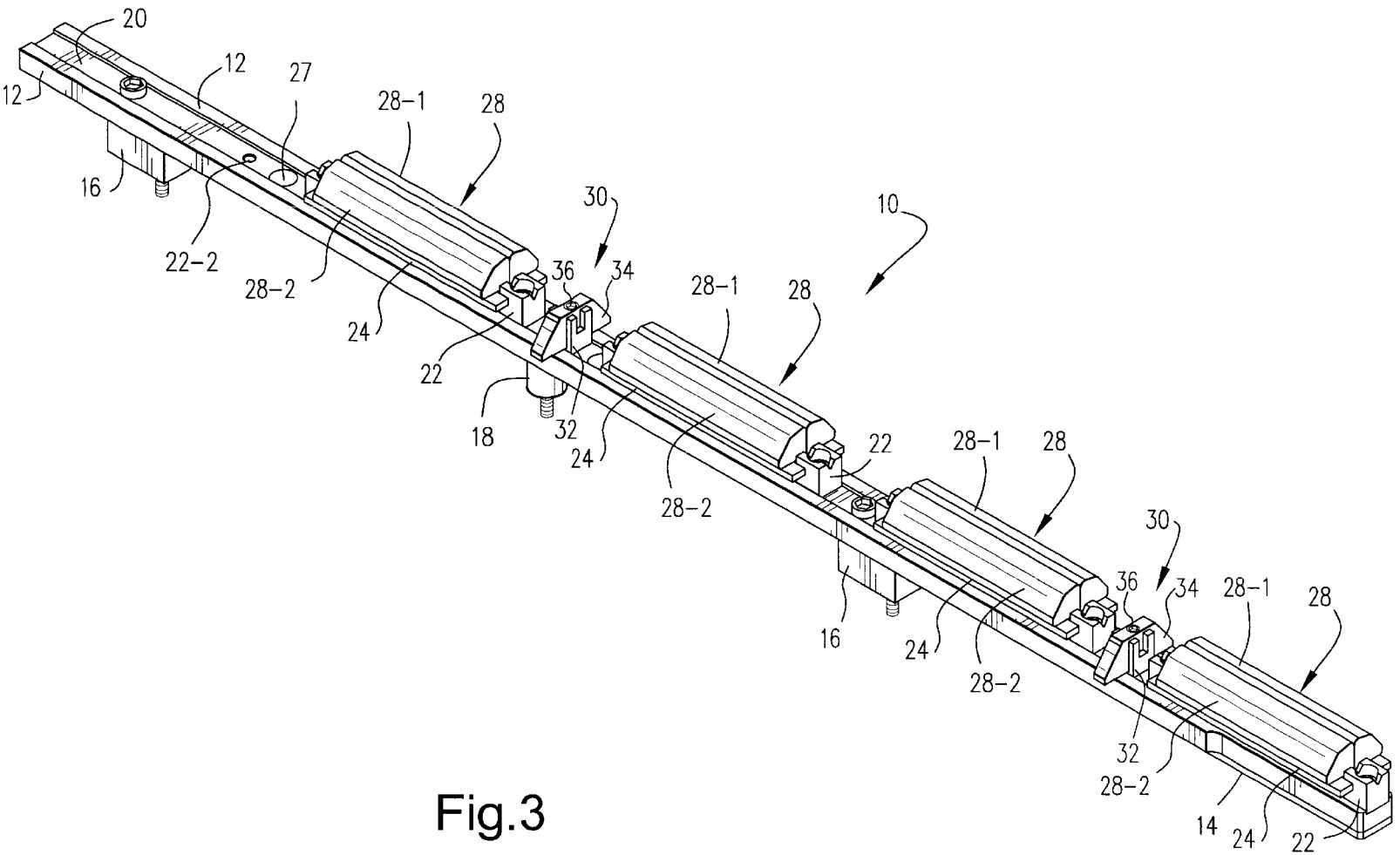
FIG. 3 is an assembled perspective view of an exemplary Lock-up assembly in accordance with the present invention.
Figure 4:
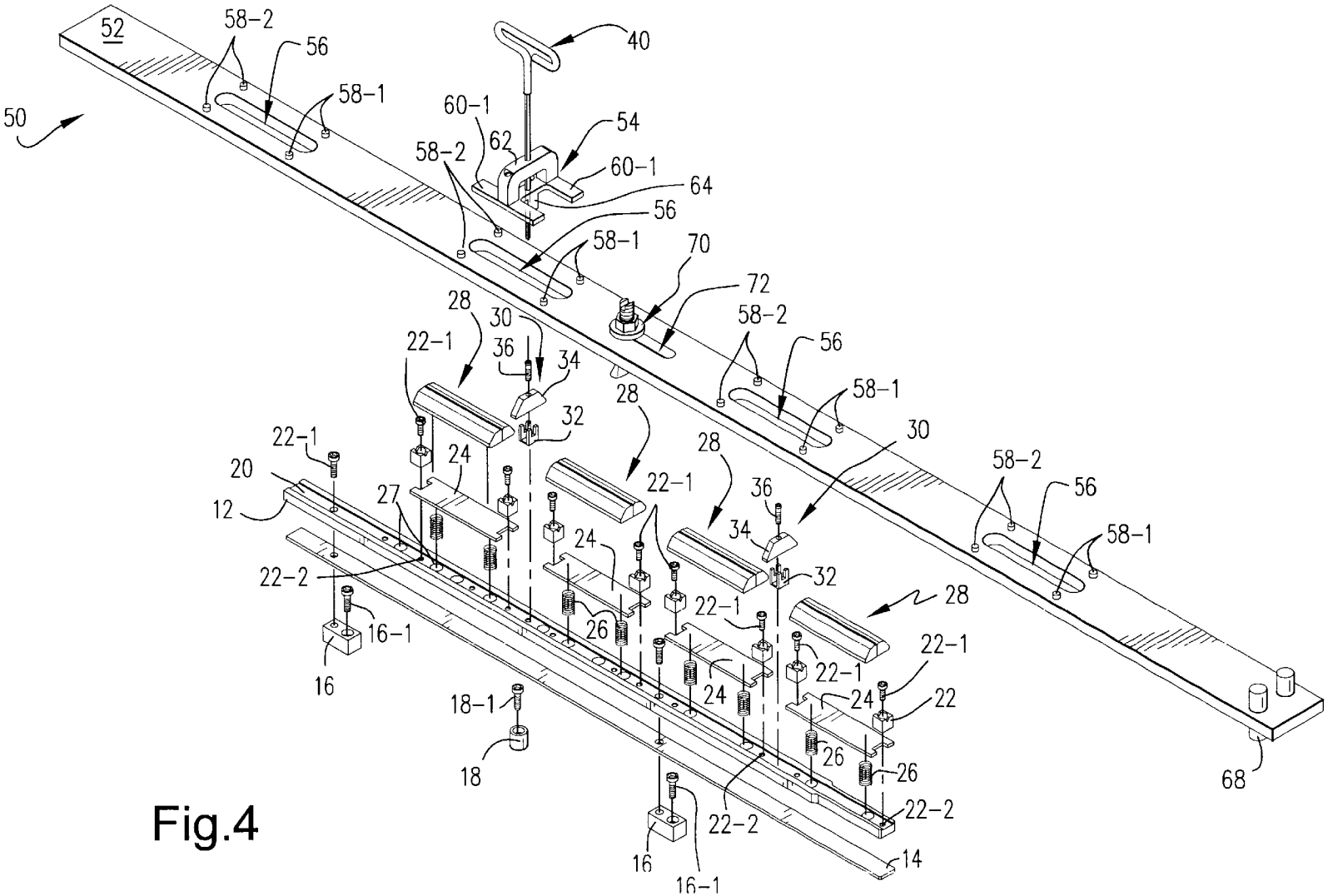
FIG. 4 is an exploded perspective view of the lock-up assembly depicted in FIG. 3 along with a gauge assembly that may be employed so as to accurately laterally shift the registration pins thereof.

In the discussion which follows, a representative few of certain structural components of the present invention have been labeled with their respective identifying reference numerals so as to improve the visual clarity of the drawing FIGS. 2–4 in which such structural components are depicted. It is, of course, to be understood also that not all structural components are visible in each one of the drawing FIGS. 2–4.

A representative lock-up assembly 10 positioned in a recessed channel or gutter $CP_g$ of the print plate cylinder CP is shown in accompanying FIG. 2. Somewhat enlarged perspective views of the lock-up assembly 10 itself is shown in an assembled and exploded condition are presented by accompanying FIGS. 3 and 4, respectively. As shown therein, the lock-up assembly 10 includes an elongate mounting bar 12 and a backing plate 14 which are structurally supported within the gutter $CP_g$ of the print plate cylinder CP by means of lateral support/spacer blocks 16 and a central support/spacer post 18. The blocks 16, 18 are coupled to the print plate cylinder CP by means of machine screws 16-1, 18-1, respectively. The mounting bar 12 and backing plate 14 are in turn coupled to the support/spacer blocks 16 by means of machine screws 12-1 so that the mounting bar 12 and backing plate are immovably fixed in position within the gutter $CP_g$.

The mounting bar 12 is provided with an elongate channel 20 on its upper surface for receiving paired sets of retainer blocks 22. Each retaining block is removeably fixed to mounting bar 12 within its channel 20 by means of machine screws 22-1 being threadably coupled to the mounting bar's corresponding sets of threaded apertures 22-2. The dimension established between the paired sets of retainer blocks 22 is spanned by jaw support plates 24.

As will be observed particularly in accompanying FIG. 4, each end of the jaw support plates 24 is notched so as to receive therein a portion of the adjacent retainer block 22. As such, the lateral position of the jaw support plates 24 is fixed, but each such plate 24 is allowed to slide between its respective paired set of retainer blocks 22 towards and away from the mounting bar 12 in a direction generally radially of the longitudinal axis of the print plate cylinder CP.

The jaw support plates 24 are encouraged in a direction away from the mounting bar 12 by the presence of compression springs 26 received in through apertures 27 formed in the mounting bar 12. Thus, the compression springs 26 are supported by the backing plate 14 and are of sufficient dimension so as to extend outwardly from the channel 20 of the mounting bar 12. The jaw support plates 24 thus rest upon, and are supported by, pairs of such springs 26. In such a manner, the springs 24 exert a bias force on the jaw support plates 24 so as to cause them to move away from the mounting bar 12.

Figure 5:
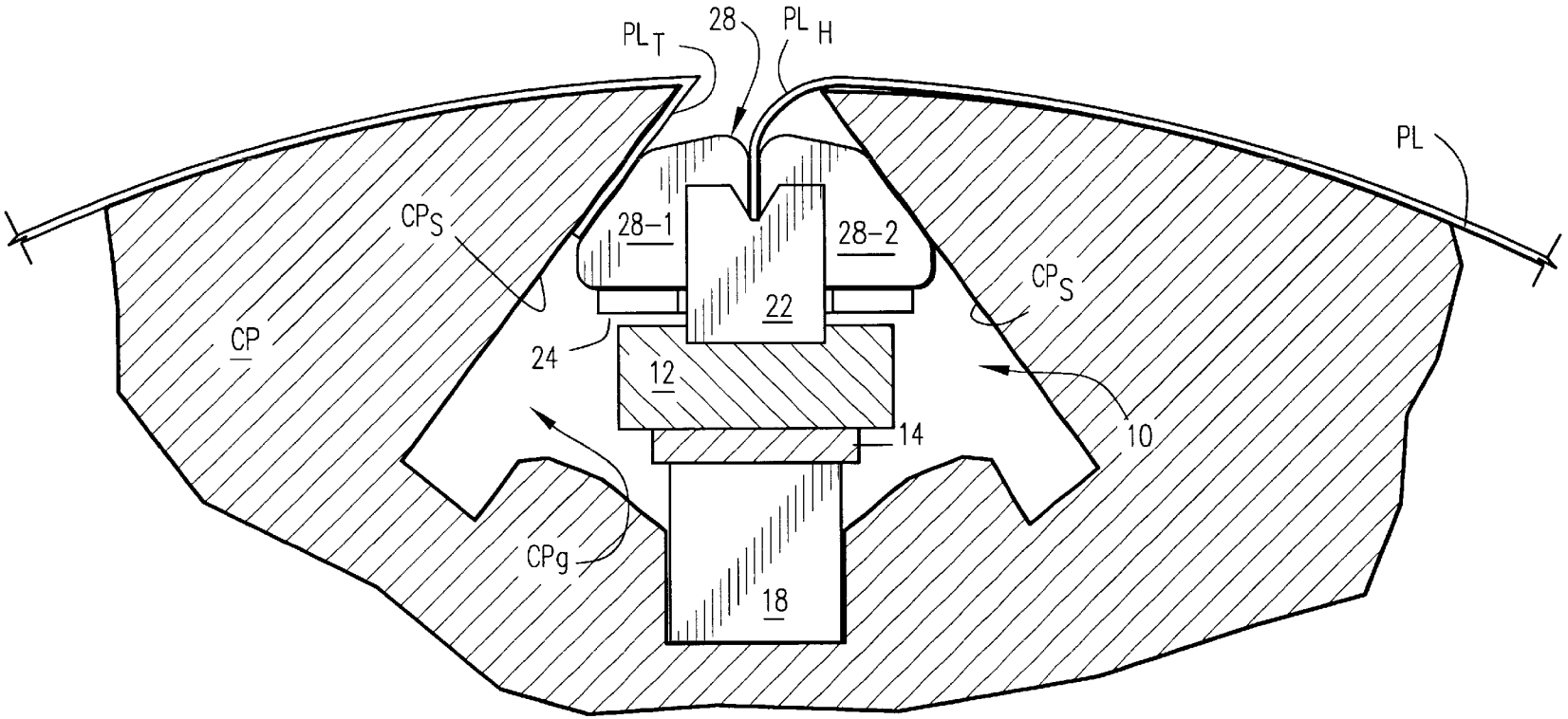
FIG. 5 is an enlarged cross-sectional view of the printing plate roll and lock-up assembly associated therewith as taken along line 5—5 in FIG. 2, and also showing the manner in which the head and tail edges of the printing plate may be captured.

Jaw pairs 28 comprised of mirror-image jaw members 28-1, 28-2 rest upon the surfaces of respective ones of the jaw support plates 24. As is perhaps best shown in accompanying FIG. 5, the jaw members 28-1, 28-2 are generally triangularly shaped so as to conform to the converging internal surfaces $CP_s$ of the gutter $CP_g$. Thus, the bias force of the compression springs 26 is sufficient to forcibly move the jaw pairs 28 so that each jaw member 28-1, 28-2 is forced against the internal surfaces $CP_s$ of the gutter $CP_g$. Since the internal surfaces $CP_s$ of the gutter $CP_g$ converge towards one another near the exterior circumferential surface of the print plate cylinder CP, the upward bias force provided by the springs 26 will create a camming effect of sorts on the individual jaw members 28-1, 28-2. That is, the jaw members 28-1, 28-2 will be responsively pressed tightly together so that a leading edge or head portion $PL_H$ of the print plate PL may be captured therebetween. The trailing edge or tail portion $PL_T$ of the print plate PL may thus be captured between the jaw member 28-1 and its corresponding adjacent internal surface $CP_s$ of the print plate cylinder CP. In such a manner, the print plate PL is positionally captured on the exterior circumferential surface of the print cylinder CP. Also, since the jaw support plates 24 are spaced physically from the mounting bar 12, by pressing the jaw pairs 28 in a direction against the bias force of the springs 26, the jaw members 28-1, 28-2 will be physically disengaged from the surfaces $CP_s$ thereby allowing the plate head and tail portions $PL_H$, $PL_T$, respectively, to be removed therefrom (i.e., since the clamping force thereon will have been relieved).

In order to accurately position the individual print plates PL on the exterior surface of the print plate cylinder CP, the lock-up assemblies 10 in accordance with the present invention are provided with a registration pin assembly 30. In this regard, it will be observed that, for example in FIG. 3, that a single registration pin assembly 30 is most preferably provided between a set of jaw pairs 28. As such, each registration pin assembly 30 may be employed to position accurately a respective one of the print plates PL in a width-wise direction of the web onto which the image is to be printed (i.e., in a direction parallel to the longitudinal axis of the print plate cylinder CP). In addition, as will be discussed in greater detail below, the space between such sets of jaw pairs 28 allows for the repositioning of the registration pin assembly 30 relatively easily to thereby allow the lock-up assembly 10 to accommodate at least two different print plate (and hence printing web) widths.

As shown in greater detail in accompanying FIGS. 6–7, the registration pin assembly 30 includes a slotted pin cradle 32 which rests upon, and is thus supported by, the mounting bar 12 within its channel 20. The pin cradle 32 may thus be moved longitudinally along the channel 20. An essentially planar, generally triangularly shaped registration pin 34 is received within the pin cradle 32 in such a manner as to be oriented substantially transversely to the longitudinal extent of the mounting bar 12 (and thus also substantially transverse to the rotational axis of the print plate cylinder CP). A jack screw 36 is threadably received within a threaded central bore 34-1 (see FIG. 7) of the registration pin 34. The jack screw 36 is of sufficient length so that its terminal end bears against the base of the pin cradle 32.

The lateral edges of the registration pin conform closely to the internal surfaces $CP_s$ of the print plate cylinder CP. Since the terminal end of the jack screw 36 bears against the base of the pin cradle 32, upon turning movement being applied to the jack screw 36, e.g., such as by turning tool 40, the registration pin 34 may be reciprocally jacked towards and away from the internal surfaces $CP_s$ of the gutter $CP_g$ (i.e., in the directions of the arrows A of FIG. 7). Thus, the registration pin 34 may be brought into tight press-fit relationship with the internal surfaces $CP_s$ of the gutter $CP_g$ so as to immovably positionally fix the entire registration pin assembly 30. However, by reversing the tightening motion applied to the jack screw 36 via tool 40, the tight press-fit relationship between the registration pin 34 and the internal surfaces $CP_s$ of the gutter $CP_g$ may be released easily allowing the registration pin assembly 30 to be moved along the channel 20 of the mounting bar 12 and thereby allow a change of its position.

As may be appreciated, the positional accuracy of the registration pin assembly 30 is important in order to ensure proper image printing and image registration (especially when printing color images). According to the present invention, such positional accuracy is ensured by using the positioning gauge system 50. In addition to the previously mentioned turning tool 40, the gauge system 50 in accordance with the present invention generally includes a gauge bar 52 and a gauge block 54. As is probably most clearly depicted in accompanying FIGS. 4 and 6, the gauge bar 52 includes a series of elongate windows 56 having pairs of raised stops 58-1, 58-2 generally at each end thereof.

The gauge block 54 is provided with a base plate 60 which most preferably has an H-shaped configuration to thereby defining a pair of leg sections 60-1 which are spaced-apart by a sufficient dimension so as to straddle the windows 56. A handle member 62 is fixed centrally to the plate 60 to allow the base plate 60 to be laterally shifted along the top surface of the gauge bar 52 between the pairs of raised stops 58-1, 58-2. A slotted finger block 64 depends from the base plate 60. The finger block 64 is sized so as to be received within the windows 56 and thereby be freely moveable therewithin. On the other hand, the slot of the finger block 64 is sized so as to accept therein the thickness dimension of the registration pin 34. As shown especially in FIG. 6, with the registration pin 34 received within the slot of the finger block 64, the pin cradle 32 and the finger block 64 are in positive contact with one another.

The lengthwise dimensions of the leg sections 60-1 and the separation distance between the paired stops 58-1 and 58-2 are gauged so as to correspond to one and another positions of the registration pin assembly 30 along the mounting bar 12 (i.e., so as to allow the registration pin assembly 30 to be moved along the mounting bar 12 so as to accommodate different print plate widths). In order to ensure positional accuracy, the gauge bar 52 itself is provided at least at one end thereof with protruding positioning pins 68 which are adapted to seat within the lateral circumferential channel LC near one end of the print plate cylinder CP (see FIG. 1). A flat-headed bolt and nut attachment assembly 70 is provided substantially midway of the gauge bar 52 within elongate slot 72.

In order to effect a positional change of the registration pin assembly 30, the gauge bar 52 is laid onto the exterior circumferential surface of the print plate cylinder CP parallel to its elongate (rotational) axis by positioning the pins 68 of the gauge bar 52 in the lateral channel LC. In order to positionally retain the gauge bar 52, the head of the assembly 70 is manipulated so it is received within the gutter $CP_g$ and then rotated approximately 90° therewithin. Tightening of the nut of the assembly 70 will therefore cause the head of the bolt to bear against the internal surface $CP_s$ and thereby positionally fix the gauge bar 52 to the exterior surface of the print plate cylinder CP. When the gauge bar 52 is properly positioned over the gutter $CP_g$, the registration pin assemblies 30 are therefore visible through respective ones of the windows 56.

The gauge block 54 may then be positioned over one of the registration pin assemblies 30 desired to be shifted laterally such that the through apertures 62-1 and 60-2 defined in the handle 62 and base plate 60 are aligned with the head of the jack screw 36. The shaft 40-1 of the turning tool 40 may thus be inserted through these apertures 62-1, 60-2 so as to be engaged with the head of the jack screw and thereby allow turning movements applied to the tool handle 40-2 to be transmitted to the jack screw 36. In such a manner, the registration pin 34 may be jacked away from its positive engagement with the internal surfaces $CP_s$ of the gutter $CP_g$ to allow the entire registration pin assembly 30 to be moved along the mounting bar 12 within channel 20 to another location. Since the finger block 64 of the gauge block 54 is engaged with the registration pin 34, sliding movement of the entire gauge block 54 along the surface of the gauge bar 52 will responsively carry the registration pin assembly 30 therewith as depicted by the phantom lines in FIG. 6. As a result, the registration pin assembly 30 may be moved physically from one location to another location on the support bar 12. Furthermore, the precise location of the registration pin assembly 30 is established when the terminal ends of the leg sections 60-1 abut against respective ones of the stops 58-1, 58-2. Once located at its new desired location, turning movement may again be applied to the tool 40 to cause the jack screw 36 to jack the registration pin 34 into tight engagement with the internal surfaces $CP_s$ of the gutter $CP_g$. The technique described above may be repeated for other registration pin assemblies that may need to be positionally shifted along the support bar 12.

As should now be appreciated, multiple sets of the paired spring-receiving apertures 27 and threaded apertures 22-2, may be provided for a particular support bar 12 so as to allow for the structures associated with the jaw pairs 28 to be physically moved between one and another locations therealong and thereby accommodate in advance different print plate widths that may normally be encountered. Thus, the lock-up assemblies of the present invention can be adapted to have somewhat universal usefulness for virtually any desired different widths of print plates (and hence printable webs) that may expected to be encountered in particular printing plant operations.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A print plate lock-up assembly adapted to be received within a gutter of a print plate cylinder, said lock-up assembly comprising (a) an elongate support bar assembly, and (b) at least one jaw assembly supported by said support bar assembly, said jaw assembly for positionally clamping a print plate to an exterior circumferential surface of the print plate cylinder, and including:

a pair of retainer blocks which are spaced from one another along the support bar assembly;

a jaw support plate positioned between said pair of retainer blocks and adapted for movement along said pair of retainer blocks towards and away from said support bar assembly;

a pair of jaw members positioned upon and supported by said jaw support plate; and a spring member acting between said support bar assembly and said jaw support plate so as to exert a bias force against said jaw support plate to move said jaw support plate, and said pair of jaw members supported thereby, in a direction away from said support bar assembly.

2. The lock-up assembly of claim 1, wherein said retainer blocks are moveable along said support plate between first and second locations.

3. The lock-up assembly of claim 1 or 2, wherein said support bar assembly includes a support bar which includes a plurality of through apertures, and a backing plate for closing said through apertures, wherein said spring member is received within a respective one of said through apertures and is supported by said backing plate.

4. The lock-up assembly as in claim 1, which comprises:

a first and second of said at least one jaw assembly spaced from one another along said support bar assembly; and a registration pin assembly which is supported by said support bar assembly between said first and second jaw assemblies so as to be shiftable therealong between one and another locations.

5. The lock-up assembly as in claim 4, wherein said registration pin assembly includes:

(i) a pin cradle supported upon said support bar assembly and shiftable therealong between said one and another locations and defining a slot oriented generally transverse to said support bar assembly;

(ii) a registration pin received within said slot of said pin cradle and having a threaded bore; and (iii) a threaded jack screw threadably received within said threaded bore of said registration pin so that a terminal end thereof bears against said pin cradle, wherein turning movements applied to said jack screw responsively causes said registration pin to be raised or lowered relative to said pin cradle.

6. A print plate lock-up assembly adapted to be received within a gutter of a print plate cylinder, said lock-up assembly comprising:

(a) an elongate support bar assembly, (b) at least one pair of first and second spaced apart jaw assemblies supported by said support bar assembly, said jaw assemblies for positionally clamping a print plate to an exterior circumferential surface of the print plate cylinder, and (c) a registration pin assembly supported by said support bar assembly and being shiftable therealong between at least one and another locations, wherein each said first and second jaw assemblies include;

a pair of retainer blocks which are spaced from one another along the support bar assembly;

a jaw support plate positioned between said pair of retainer blocks and adapted for movement along said pair of retainer blocks towards and away from said support bar assembly;

a pair of jaw members positioned upon and supported by said jaw support plate; and spring members acting between said support bar assembly and said jaw support plate so as to exert a bias force against said jaw support plate to move said jaw support plate, and said pair of jaw members supported thereby, in a direction away from said support bar assembly.

7. The lock-up assembly of claim 6, wherein said retainer blocks are moveable along said support plate between first and second locations so that at least one of said first and second jaw assemblies may assume respective first and second different locations on said support bar assembly.

8. The lock-up assembly of claim 6 or 7, wherein said support bar assembly includes a support bar which includes a plurality of through apertures, and a backing plate for closing said through apertures, wherein said spring members are received within respective ones of said through apertures and are supported by said backing plate.

9. The lock-up assembly as in claim 6, wherein said registration pin assembly includes:

(i) a pin cradle supported upon said support bar assembly and shiftable therealong between said one and another locations and defining a slot oriented generally transverse to said support bar assembly;

(ii) a registration pin received within said slot of said pin cradle and having a threaded bore; and (iii) a threaded jack screw threadably received within said threaded bore of said registration pin so that a terminal end thereof bears against said pin cradle, wherein turning movements applied to said jack screw responsively causes said registration pin to be raised or lowered relative to said pin cradle.

10. A print plate lock-up assembly comprising:

a support bar assembly adapted to being positioned within a print plate cylinder gutter;

a jaw assembly supported upon said support bar assembly for positionally locking head and tail edges of a print plate within the print plate cylinder gutter; and a registration pin assembly which is laterally shiftable between one and another locations within the cylinder gutter; wherein said registration pin assembly includes;

(i) a pin cradle supported upon said support bar assembly and shiftable therealong between said one and another locations and defining a slot oriented generally transverse to said support bar assembly;

(ii) a registration pin received within said slot of said pin cradle and having a threaded bore; and (iii) a threaded jack screw threadably received within said threaded bore of said registration pin so that a terminal end thereof bears against said pin cradle, wherein turning movements applied to said jack screw responsively causes said registration pin to be raised or lowered relative to said pin cradle.

* * * * *